US006993998B1

(12) United States Patent
Kao et al.

(10) Patent No.: US 6,993,998 B1
(45) Date of Patent: Feb. 7, 2006

(54) WRENCH HAVING ANGLE ADJUSTABLE HANDLE

(76) Inventors: Chein Chuan Kao, No. 1, Avenue 37, Lane 232, Yonsin Road, Dali City, Taichung Hsien 41265 (TW); Chia Yu Chen, No. 23-2, Juanei Lane, Beitun Chu, Taichung 40682 (TW)

( * ) Notice: Subject to any disclaimer, the term of this patent is extended or adjusted under 35 U.S.C. 154(b) by 0 days.

(21) Appl. No.: 11/047,845

(22) Filed: Feb. 1, 2005

(51) Int. Cl.

| | |
|---|---|
| ***B25B 23/16*** | (2006.01) |
| ***B25B 1/00*** | (2006.01) |
| ***B25B 13/46*** | (2006.01) |
| ***F16C 11/00*** | (2006.01) |
| ***B25G 3/28*** | (2006.01) |

(52) U.S. Cl. ..... 81/60; 81/177.9; 81/177.8; 81/177.7; 81/177.85; 403/97; 403/103; 403/359.1

(58) Field of Classification Search ..... 81/177.9, 81/177.8, 177.7, 177.85, 60; 403/97, 103, 403/359.1, 359.2, 314

See application file for complete search history.

(56) References Cited

U.S. PATENT DOCUMENTS

| | | | | |
|---|---|---|---|---|
| 5,199,335 | A | 4/1993 | Arnold et al. | 81/177.8 |
| 5,941,141 | A * | 8/1999 | Whitley | 81/63.1 |
| 6,216,565 | B1 | 4/2001 | McCann | 81/177.8 |
| 6,216,567 | B1 | 4/2001 | Hu | 81/177.9 |
| 6,752,048 | B1 * | 6/2004 | Chiang | 81/63.1 |
| 2005/0016332 | A1 * | 1/2005 | Hu | 81/177.8 |
| 2005/0044994 | A1 * | 3/2005 | Hsien | 81/60 |

* cited by examiner

*Primary Examiner*—Joseph J. Hail, III
*Assistant Examiner*—Bryan Muller
(74) *Attorney, Agent, or Firm*—Charles E. Baxley

(57) ABSTRACT

A wrench includes a tool head having a number of teeth formed in a chamber, and a handle having a shaft rotatably engaged into the chamber of the tool head and having a channel laterally formed in the shaft, a stem is engaged into the channel of the shaft, and includes one or more actuators. A follower is slidably received in the channel of the shaft, and includes one or more teeth for engaging with the teeth of the tool head, and for selectively locking the handle to the tool head at selected angular position. The follower includes a space formed by an inner peripheral surface, for engaging with the actuators. One of the actuators may force the teeth of the follower to solidly engage with the teeth of the tool head.

5 Claims, 5 Drawing Sheets

WRENCH HAVING ANGLE ADJUSTABLE HANDLE

BACKGROUND OF THE INVENTION

1. Field of the Invention

The present invention relates to a wrench, and more particularly to a wrench having a pivotal handle adjustable to various angular position relative to the driving cartridge or the driving head.

2. Description of the Prior Art

Typical flex-head wrenches comprise a handle pivotally connected to a tool head, and a locking mechanism having a unitary locking spool seated within the handle and manipulated to lock or unlock the tool head at a desired angular position with respect to the handle.

For example, U.S. Pat. No. 5,199,335 to Arnold et al. discloses one of the typical flex-head wrenches comprising a unitary locking spool seated within a handle and having a cooperating series of teeth extending around a portion of the spool, for engaging with the corresponding teeth of a hub of the tool head, to lock the handle to the tool head in place.

However, the engagement of the teeth of the spool with the corresponding teeth of the hub of the tool head is similar to the typical ratchet mechanism for tools, and the spool may be easily forced to move along a longitudinal axis of the spool that is perpendicular to the tool head, and the spool is parallel to the rotational or moving plane of the handle, such that the spool may have a good chance to be easily forced to move out of or to be disengaged from the tool head when the handle is rotated relative to the tool head.

U.S. Pat. No. 6,216,567 to Hu discloses another similar typical flex-head wrench comprising a handle pivotally connected to a tool head, and a catch slidably engaged in a longitudinal hole of one end of the handle, and a push button rotatably and slidably engaged in a transverse hole of the handle and having a projected supporting surface for engaging with the catch, and for forcing the catch to engage with and to lock the tool head.

However, the push button is rotatably and slidably engaged in the transverse hole of the handle, and thus may have a good chance to be rotated relative to the handle, and thus to disengage the projected supporting surface from the catch, and such that the push button may not be used for suitably locking and unlocking the tool head with the catch.

U.S. Pat. No. 6,216,565 to McCann discloses a further typical flex-head wrench comprising a handle pivotally connected to a tool head and rotatable relative to the tool head in a rotating plane parallel to the plane of the tool head, and a pawl slidably disposed between a driving cartridge and the handle to selectively couple and lock the driving cartridge to the handle at the required or selected angular position.

An additional barrel is further required to be provided and disposed between the driving cartridge and the handle, to enclose the pawl therein, and includes one or more projections extended therein to engage with the pawl, and to move the pawl up and down to engage with teeth of a shaft, and to selectively lock and unlock the driving cartridge to the handle.

However, the provision and the engagement of the pawl and the barrel between the driving cartridge and the handle may increase the distance between the driving cartridge and the handle, and thus may increase the driving instability of the driving cartridge by the handle.

The present invention has arisen to mitigate and/or obviate the afore-described disadvantages of the conventional wrenches.

SUMMARY OF THE INVENTION

The primary objective of the present invention is to provide a wrench including a pivotal handle adjustable to various angular position relative to the driving cartridge or the driving head, and including a solid adjustable and securing mechanism to solidly secure the handle to the driving cartridge or the driving head at the predetermined or selected angular position.

In accordance with one aspect of the invention, there is provided a wrench comprising a tool head including a chamber formed in a rear portion thereof, and a plurality of teeth formed therein, and including a driving mechanism provided within the tool head for engaging with and for driving fasteners and tool members, a handle including a shaft extended from a first end thereof, and rotatably engaged into the chamber of the tool head, and including a channel laterally formed in the shaft to define two arms, a stem rotatably secured to the first end thereof, and rotatably engaged into the channel of the shaft, and including a first actuator extended therefrom, and including a knob attached to the stem and located outside the handle, for rotating the and actuating the stem with the knob, and a follower slidably received in the channel of the shaft, and including at least one tooth provided thereon, for engaging with the teeth of the tool head, and for selectively locking the handle to the tool head at selected angular position, the follower including a space formed therein and defined by an inner peripheral surface, for engaging with the first actuator of the stem. The first actuator of the stem is forced to engage with the inner peripheral surface of the follower, and to force the tooth of the follower to engage with the teeth of the tool head, and thus to solidly lock the handle to the tool head at the selected angular position when the stem is rotated relative to the shaft of the handle with the knob, and the tooth of the follower is disengaged from the teeth of the tool head when the stem is further rotated relative to the shaft of the handle to disengage the first actuator of the stem from the inner peripheral surface of the follower.

The tool head includes an enlarged peripheral shoulder formed therein and located around the chamber thereof, and a cap secured to the shaft and rotatably seated and engaged in the peripheral shoulder of the tool head, to rotatably anchor said cap to the tool head. The follower includes a substantially rectangular structure, for snugly fitting in the channel of the shaft and between the arms of the shaft, to prevent the follower from sliding sidewise relative to the shaft.

The follower includes a first end having the tooth formed thereon, and a second end having a cavity formed therein and located opposite to the tooth, and a spring biased projection received in the cavity of the follower and engaged with the teeth of the tool head.

The follower includes one or more swellings extended into the space thereof, and the stem includes one or more further actuators extended therefrom, for engaging with the swellings of the follower, and for disengaging the tooth of the follower from the teeth of the tool head.

Further objectives and advantages of the present invention will become apparent from a careful reading of the detailed description provided herein below, with appropriate reference to the accompanying drawings.

DETAILED DESCRIPTION OF THE PREFERRED EMBODIMENT

Figure 1:
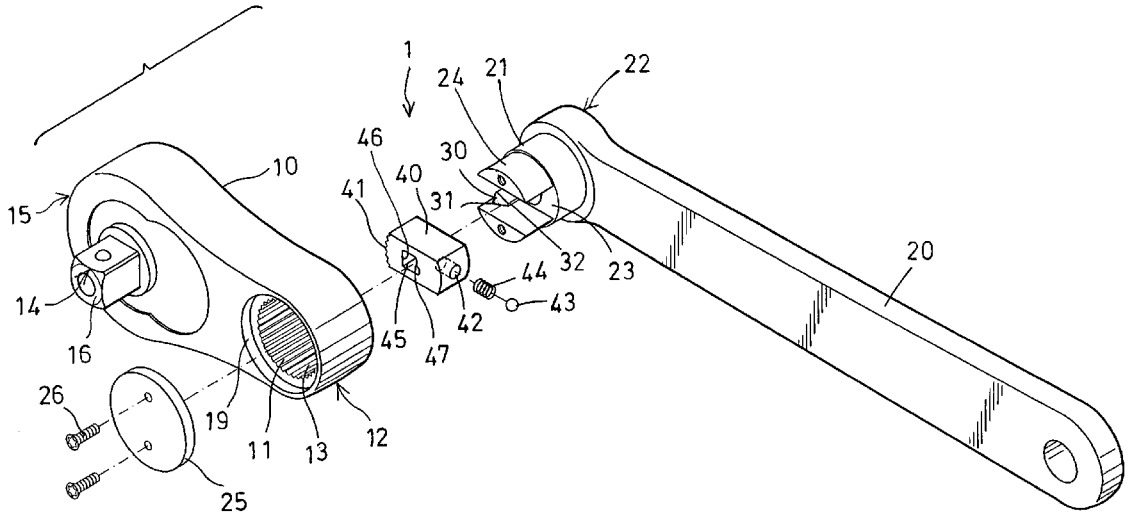
FIG. 1 is a partial exploded view of a wrench in accordance with the present invention.
Figure 2:
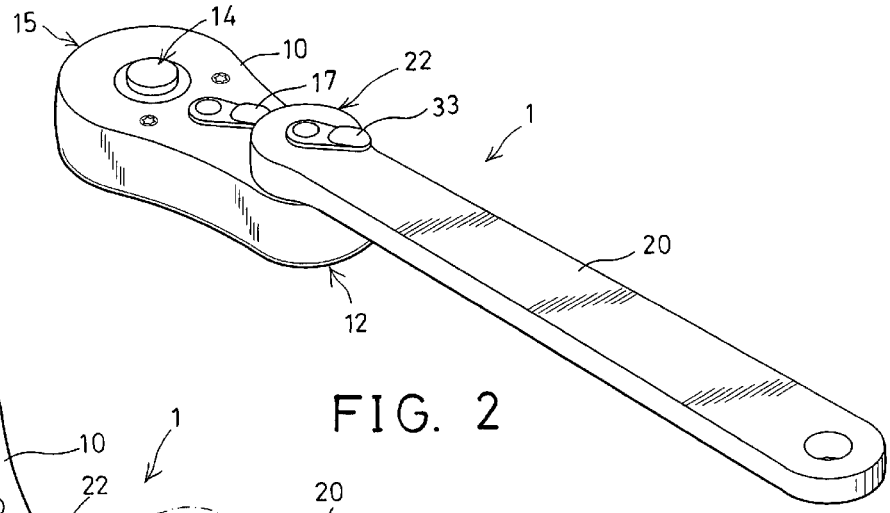
FIG. 2 is an upper perspective view of the wrench.
Figure 3:
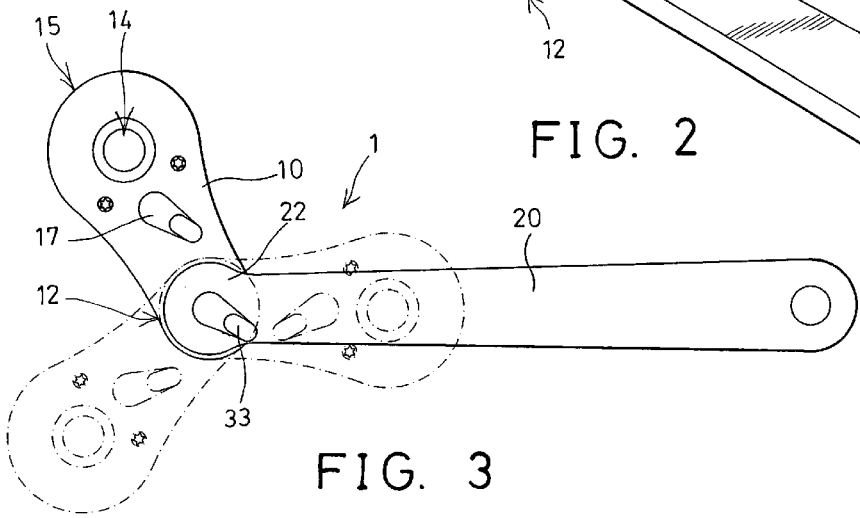
FIG. 3 is an upper plane view of the wrench, illustrating the operation of the wrench.
Figure 4:
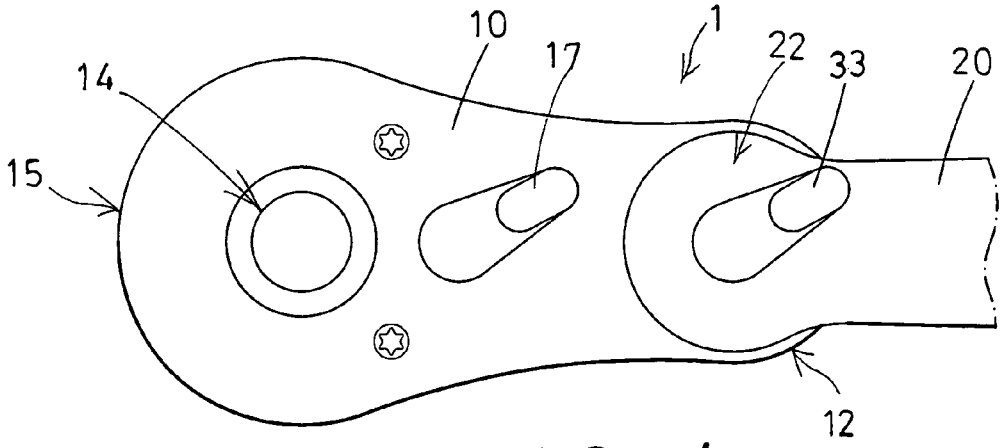
FIGS. 4, 5 are partial upper plane views illustrating the operation of the wrench.

Referring to the drawings, and initially to FIGS. 1–7, a wrench 1 in accordance with the present invention comprises a tool head 10 including a chamber 11 formed therein, such as formed in the rear portion 12 thereof, and having a number of teeth 13 formed therein, and including a driving mechanism 14 provided within the tool head, such as provided in the front portion 15 thereof, and having a driving shank 16 extended therefrom (FIGS. 1, 6, 7), for engaging with and for driving fasteners, tool extensions, sockets and tool bits, or other tool members.

Figure 8:
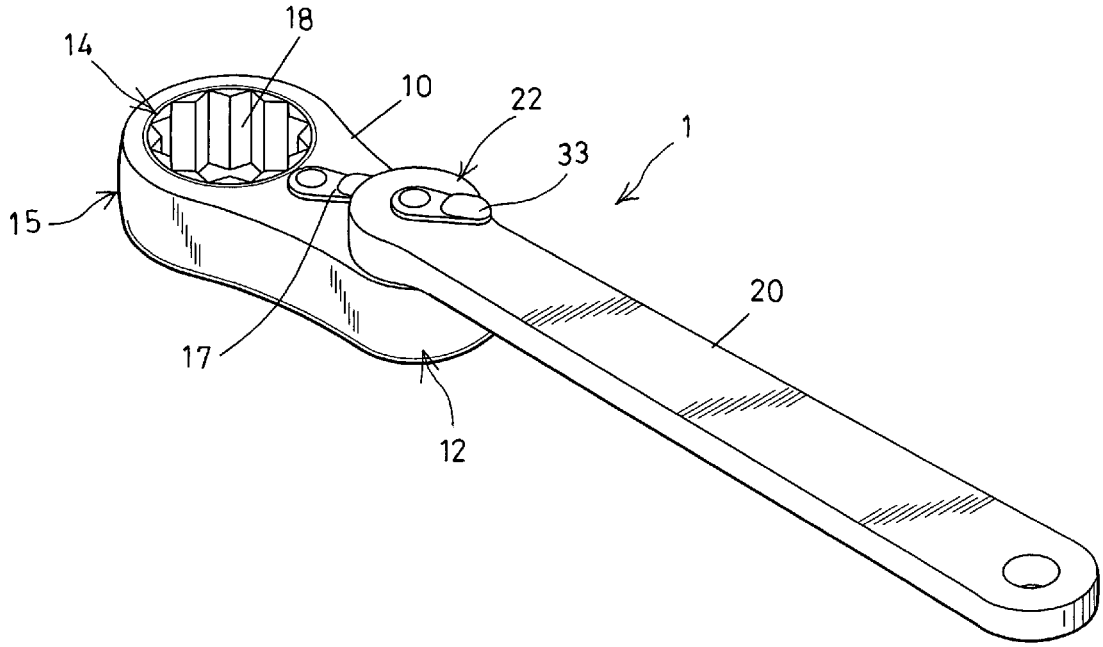
FIG. 8 is a perspective view illustrating the other arrangement of the wrench.

Normally, the driving mechanism 14 includes a knob 17 extended out of the tool head 10, and coupled to an inner pawl (not shown), for controlling the driving direction of the driving mechanism 14. Alternatively, the driving mechanism 14 may include an engaging hole 18 formed therein, as shown in FIG. 8, for receiving and for driving fasteners, tool extensions, sockets and tool bits, or other tool members. The above-described structure for the driving mechanism 14 is typical and will not be described in further details.

A handle 20 includes a shaft 21 extended from one end 22 thereof, and rotatably engaged into the chamber 11 of the tool head 10, and includes a channel 23 laterally formed in the shaft 21, to form or define two arms 24. A cap 25 may be secured to the shaft 21 with connecting means such as fasteners 26, to rotatably secure the shaft 21 to the tool head 10, and to prevent the shaft 21 from being disengaged from the tool head 10. For example, the tool head 10 may include an enlarged peripheral shoulder 19 formed therein and located around the chamber 11 thereof, and to rotatably seat and anchor the cap 25 to the tool head 10.

The handle 20 further includes a stem 30 rotatably secured to the one end 22 thereof, and rotatably engaged into the channel 23 of the shaft 21, and includes one or more, such as two actuators 31, 32 extended therefrom, and includes a knob 33 attached to an outer end thereof and located outside the handle 20, for allowing the users to rotate and to operate or to actuate the stem 30 with the knob 33 (FIGS. 3–7).

A follower 40 is slidably engaged or received in the channel 23 of the shaft 21, and includes a substantially rectangular structure, for snugly fitting in the channel 23 of the shaft 21, and snugly guided between the arms 24 of the shaft 21, to guide the follower 40 to smoothly slide along the channel 23 of the shaft 21, and to prevent the follower 40 from sliding laterally or sidewise relative to the shaft 21.

The follower 40 includes one or more teeth 41 formed or provided on one end thereof, for engaging with the teeth 11 of the tool head 10, and for selectively locking the handle 20 to the tool head 10 at predetermined or selected angular position. The follower 40 further includes a cavity 42 formed in the other end thereof, and located opposite to the teeth 41, for receiving a spring biased projection 43, such as a ball 43 and a spring 44 therein. The ball 43 of the spring biased projection 43 may also be biased to engage with the teeth 11 of the tool head 10, and to anchor or position the handle 20 to the tool head 10.

Figure 6:
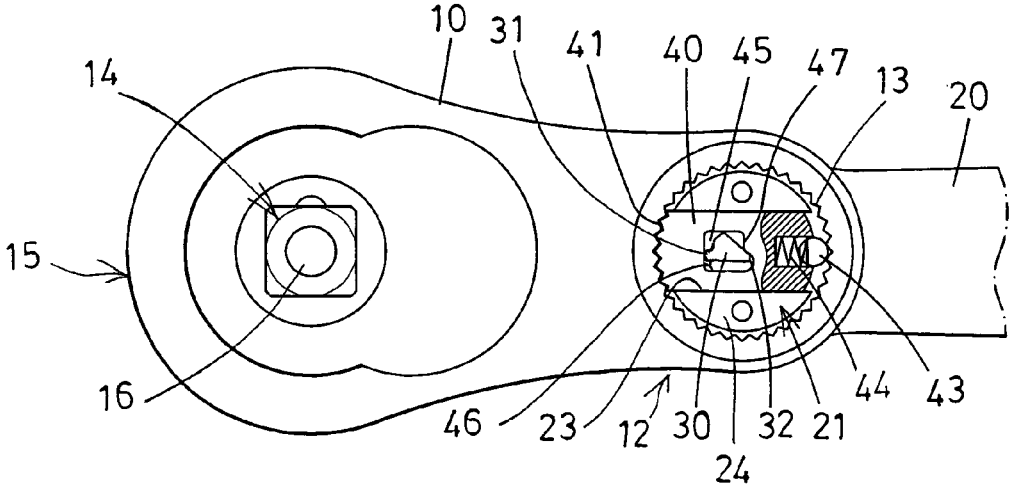
FIGS. 6, 7 are partial bottom plane views of the wrench as shown in FIGS. 4 and 5 respectively.
Figure 5:
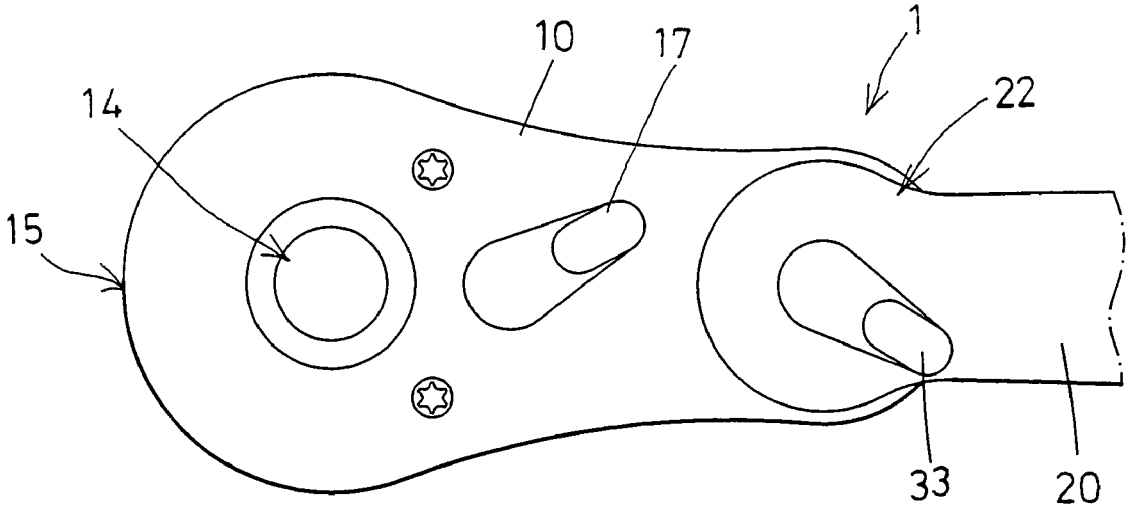

The follower 40 further includes a space 45 formed therein and defined by an inner peripheral surface 46, and having one or more swellings or seats 47 extended into the space 45 thereof, for engaging with the actuators 31, 32 of the stem 30. For example, as shown in FIG. 6, when the stem 30 is rotated relative to the shaft 21 of the handle 20 with the knob 33 (FIG. 4), one of the actuators 31 of the stem 30 may be forced to engage with the inner peripheral surface 46 of the follower 40, to force to the teeth 41 of the follower 40 to engage with the teeth 11 of the tool head 10, and thus to selectively lock the handle 20 to the tool head 10 at the predetermined or selected angular position.

Figure 7:
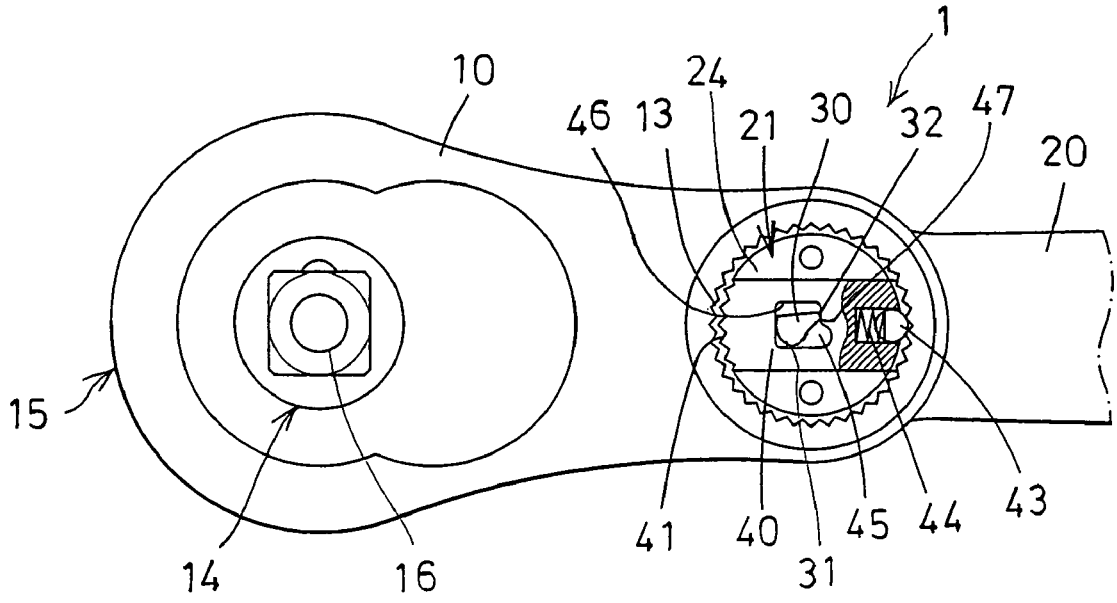

Alternatively, as shown in FIG. 7, the stem 30 may further be rotated relative to the shaft 21 of the handle 20 with the knob 33 (FIG. 5), to cause or to force the other actuator 32 of the stem 30 to engage with the swelling or seat 47 of the follower 40, and thus to disengage the teeth 41 of the follower 40 from the teeth 11 of the tool head 10, and thus to allow the handle 20 to be rotated freely relative to the tool head 10 to any required or selected angular position.

At this moment, or when the handle 20 is rotated freely relative to the tool head 10 to any required or selected angular position, the ball 43 of the spring biased projection 43 may also be biased to engage with the teeth 11 of the tool head 10 by the spring member 44, to generate click and click sounds, and to allow the users to note the rotational movement of the handle 20 relative to the tool head 10.

It is to be noted that the teeth 41 of the follower 40 may be forced to solidly engage with the teeth 11 of the tool head 10 by the actuator 31 of the stem 30, and will not be disengaged from the teeth 11 of the tool head 10, such that the handle 20 may be solidly anchored or locked and secured to the tool head 10 at the predetermined or selected angular position, and such that the tool head 10 may be driven by the handle 20 with an increased driving torque.

Accordingly, the wrench in accordance with the present invention includes a pivotal handle adjustable to various angular positions relative to the driving cartridge or the driving head, and including a solid adjustable and securing mechanism to solidly secure the handle to the driving cartridge or the driving head at the predetermined or selected angular position.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A wrench comprising:

a tool head including a chamber formed in a rear portion thereof, and a plurality of teeth formed therein, and including a driving mechanism provided within the tool head for engaging with and for driving fasteners and tool members, a handle including a shaft extended from a first end thereof, and rotatably engaged into said chamber of said tool head, and including a channel laterally formed in said shaft to define two arms, a stem rotatably secured to said first end thereof, and rotatably engaged into said channel of said shaft, and including a first actuator extended therefrom, and including a knob attached to said stem and located outside said handle, for rotating said and actuating said stem with said knob, and a follower slidably received in said channel of said shaft, and including at least one tooth provided thereon, for engaging with said teeth of said tool head, and for selectively locking said handle to said tool head at selected angular position, said follower including a space formed therein and defined by an inner peripheral surface, for engaging with said first actuator of said stem, and said first actuator of said stem being forced to engage with said inner peripheral surface of said follower, and to force to said at least one tooth of said follower to engage with said teeth of said tool head, and thus to solidly lock said handle to said tool head at the selected angular position when said stem is rotated relative to said shaft of said handle with said knob, and said at least one tooth of said follower being disengaged from said teeth of said tool head when said stem is further rotated relative to said shaft of said handle to disengage said first actuator of said stem from said inner peripheral surface of said follower.

2. The wrench as claimed in claim 1, wherein said tool head includes an enlarged peripheral shoulder formed therein and located around said chamber thereof, and a cap secured to said shaft and rotatably seated and engaged in said peripheral shoulder of said tool head, to rotatably anchor said cap to said tool head.

3. The wrench as claimed in claim 1, wherein said follower includes a rectangular structure, for snugly fitting in said channel of said shaft and between said arms of said shaft, to prevent said follower from sliding sidewise relative to said shaft.

4. The wrench as claimed in claim 1, wherein said follower includes a first end having said at least one tooth formed thereon, and a second end having a cavity formed therein and located opposite to said at least one tooth, and a spring biased projection received in said cavity of said follower and engaged with said teeth of said tool head.

5. The wrench as claimed in claim 1, wherein said follower includes a swelling extended into said space thereof, and said stem includes a second actuator extended therefrom, for engaging with said swelling of said follower, and for disengaging said at least one tooth of said follower from said teeth of said tool head.

* * * * *